US006941592B1

(12) United States Patent
Castillo

(10) Patent No.: US 6,941,592 B1
(45) Date of Patent: Sep. 13, 2005

(54) BATHING AID

(76) Inventor: Magdalena R. Castillo, 1001 Esplanada Cir., El Paso, TX (US) 79932

( * ) Notice: Subject to any disclaimer, the term of this patent is extended or adjusted under 35 U.S.C. 154(b) by 0 days.

(21) Appl. No.: 10/815,079

(22) Filed: Apr. 1, 2004

Related U.S. Application Data

(60) Provisional application No. 60/460,662, filed on Apr. 7, 2003.

(51) Int. Cl.[7] ..... A47K 3/02
(52) U.S. Cl. ..... 4/560.1
(58) Field of Search ..... 4/560.1, 564.1–566.1

(56) References Cited

U.S. PATENT DOCUMENTS

| | | | | | |
|---|---|---|---|---|---|
| 2,045,110 | A | * | 6/1936 | Spiess | 4/562.1 |
| 2,123,398 | A | * | 7/1938 | Bowers | 4/562.1 |
| 3,106,723 | A | | 10/1963 | Carpenter | |
| 5,072,840 | A | | 12/1991 | Asakawa et al. | |
| 5,129,112 | A | | 7/1992 | Schaffer | |
| 5,267,360 | A | * | 12/1993 | Bassil et al. | 4/560.1 |
| 5,373,591 | A | * | 12/1994 | Myers | 4/560.1 |
| D360,024 | S | | 7/1995 | Smith | |
| 5,570,482 | A | | 11/1996 | Asakawa | |
| 5,839,131 | A | | 11/1998 | Schaffer | |
| 6,003,168 | A | | 12/1999 | Steadman | |
| 6,182,304 | B1 | * | 2/2001 | Freeberg | 4/560.1 |
| 6,199,226 | B1 | * | 3/2001 | Steadman | 4/565.1 |
| 6,279,178 | B1 | * | 8/2001 | Hill | 4/578.1 |
| 6,334,225 | B1 | * | 1/2002 | Brinkmann | 4/560.1 |
| 6,336,230 | B1 | | 1/2002 | Lane | |
| 6,351,860 | B1 | | 3/2002 | Schaffer | |

* cited by examiner

*Primary Examiner*—Charles E. Phillips
(74) *Attorney, Agent, or Firm*—John D. Gugliotta; Olen L. York, III

(57) ABSTRACT

A bath tub bathing aid includes a guide rail affixed to the bath tub and projecting beyond the perimeter of the tub substantially perpendicular thereto. The guide rail is affixed to the bath tub via mounting arms. The externally projected portion of the guide rail includes a leg that supports the guide rail by resting upon a floor surface. A bathing chair or seat is provided that travels along the guide rail as actuated by the control panel and driven by a mechanically coupled motor. A separate elevation motor is mechanically coupled to control raising and lowering the seat or chair, the elevation motor coupled to and directing extension and contraction of a plurality of cables via a pulley system. The bathing aid is connected to a power source.

11 Claims, 3 Drawing Sheets

BATHING AID

RELATED APPLICATIONS

This application claims the benefit of U.S. Provisional Application No. 60/460,662, filed on Apr. 7, 2003.

BACKGROUND OF THE INVENTION

1. Field of the Invention

The present invention relates generally to home health care aids and, more particularly, to a bath tub bathing aid comprising a bath chair having an integral mechanism that raises and lowers the chair and a user into a bathtub, thereby aiding in the bathing of physically disabled or handicapped individuals.

2. Description of the Related Art

Persons that have a physical disability, including the elderly and disabled, recognize the difficulties that they encounter while performing tasks that many take for granted. Several activities, such as climbing stairs or bending over from the waist to attend to a shoe, are difficult for the elderly and disabled, and often requires extreme physical exertion to accomplish such tasks. In some instances, these activities are altogether impossible to accomplish without mechanical or personal assistance. One acknowledged activity that is extremely difficult for the elderly and the disabled is entering and exiting a conventional bathtub. For the elderly and disabled, entering and exiting a bathtub is a difficult and dangerous activity, and may result in serious physical injury and or death because the increased risk of slipping on a wet surface, the lack of grasping handles about the tub, the very hard and/or blunt surfaces of the tub and surrounding objects, among other reasons. These difficulties are compounded with those individuals who must be placed in and lifted out of a bath or shower. As a result, many people are forced to either bathe less frequently or they must obtain the assistance of two or more people to help them, which is often embarrassing and/or humiliating for the bathing party.

A search of the prior art did not disclose any patents that read directly on the claims of the instant invention; however, the following references were considered related:

- U.S. Pat. No. 2,045,110, issued in the name of Spiess, discloses a bathtub appliance that raises and lowers a user into and out of a tub;
- U.S. Pat. No. 3,106,723, issued in the name of Carpenter, discloses a bath tub seat raised and lowered by a power lift mechanism;
- U.S. Pat. No. 5,072,840, issued in the name of Asakawa et al., discloses a medical bed apparatus having a body frame, a hoisting assembly and a hammock supported from the hoisting assembly by hanging strings, the strings are used for raising and lowering the hammock via a number of drums above the hammock and assembly;
- U.S. Pat. No. 5,129,112, issued in the name of Schaffer, discloses a bathtub chair lift having a chair coupled to a movable member, the movable member raised and lowered via a motor;
- U.S. Pat. No. 5,570,482, issued in the name of Asakawa, discloses a device for raising and lowering a hammock or other body support structure onto a bed or other flat surface;
- U.S. Pat. No. 5,839,131, issued in the name of Schaffer, discloses a fluid operated chair lift;
- U.S. Pat. No. 6,003,168, issued in the name of Steadman, discloses an apparatus for moving a person into and out of a bath tub having a seat mounted to a pivot linkage for raising and lowering the seat;
- U.S. Pat. No. 6,336,230, issued in the name of Lane, discloses a device for lifting a person into and out of a bathtub;
- U.S. Pat. No. 6,351,860, issued in the name of Schaffer, discloses a chair lift for raising and lowering a seat into and out of a bathtub; and
- U.S. Pat. No. Des. 360,024, issued in the name of Smith, discloses an ornamental design for a combination bathtub and sear for handicapped and elderly persons.

Consequently, a need exists for means by which those with physical disabilities can utilize a bathtub easily and in a safe manner while placing less strain on their care givers.

SUMMARY OF THE INVENTION

It is therefore an object of the present invention to provide a bathing aid for the physically impaired.

It is a feature of the present invention to provide a bathing aid for raising and lowering the physically impaired into and out of a bath tub.

It is a further feature of the present invention to provide a bathing aid affixed to a bath tub and governed by a control panel for raising and lowering the bathing aid.

It is a further feature of the present invention to provide a bathing aid having a seat or chair that travels along a guide rail via a motor, thereby allowing the user to set in the chair externally to the tub and then actuate transport along the guide rail to within the boundary of the tub.

It is a further feature of the present invention to provide a bathing aid having a seat or chair that reclines.

Briefly described according to one embodiment of the present invention, a bath tub bathing aid includes a guide rail affixed to the bath tub and projecting beyond the perimeter of the tub substantially perpendicular thereto. The guide rail is affixed to the bath tub via mounting arms. The externally projected portion of the guide rail includes a leg that supports the guide rail by resting upon a floor surface. A bathing chair or seat is provided that travels along the guide rail as actuated by the control panel and driven by a mechanically coupled motor. A separate elevation motor is mechanically coupled to control raising and lowering the seat or chair, the elevation motor coupled to and directing extension and contraction of a plurality of cables via a pulley system. The bathing aid is connected to a power source, and may include a power cord and power plug with a ground fault interrupter to prevent electrocution or may be provided by battery supply.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
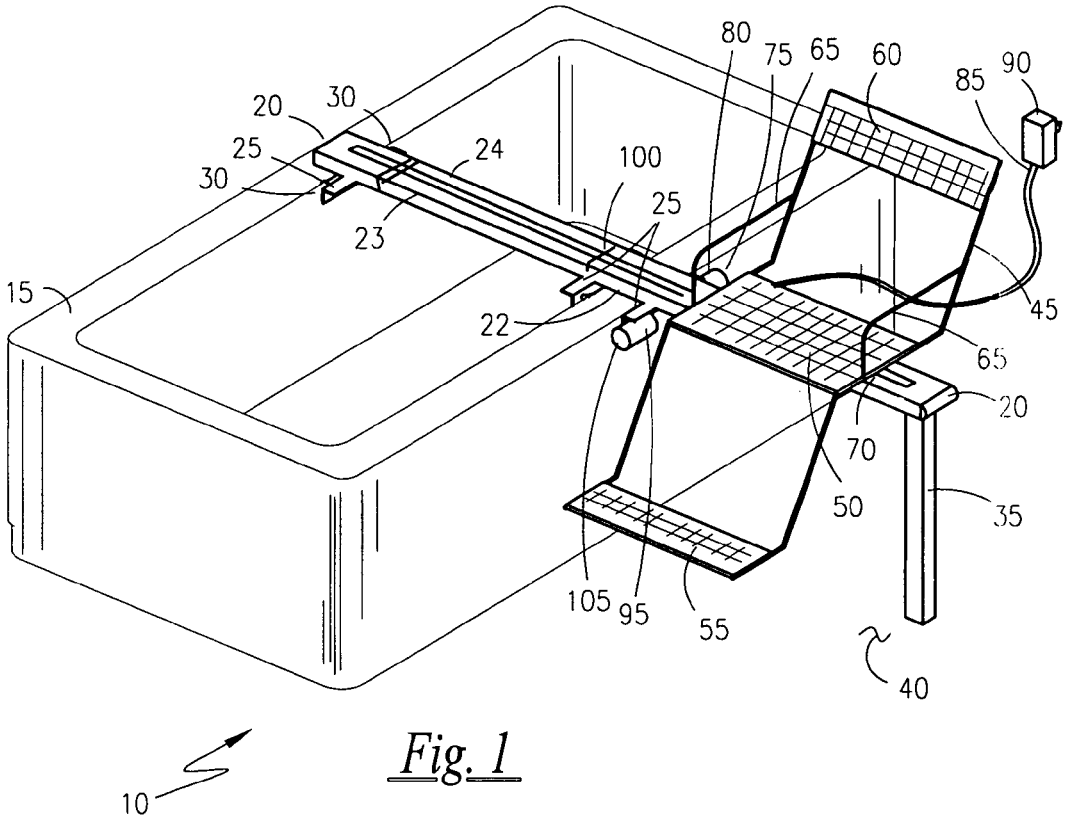
FIG. 1 is a perspective view of the bath tub bathing aid 10, shown in a ready to utilize state, according to the preferred embodiment of the present invention.
Figure 2:
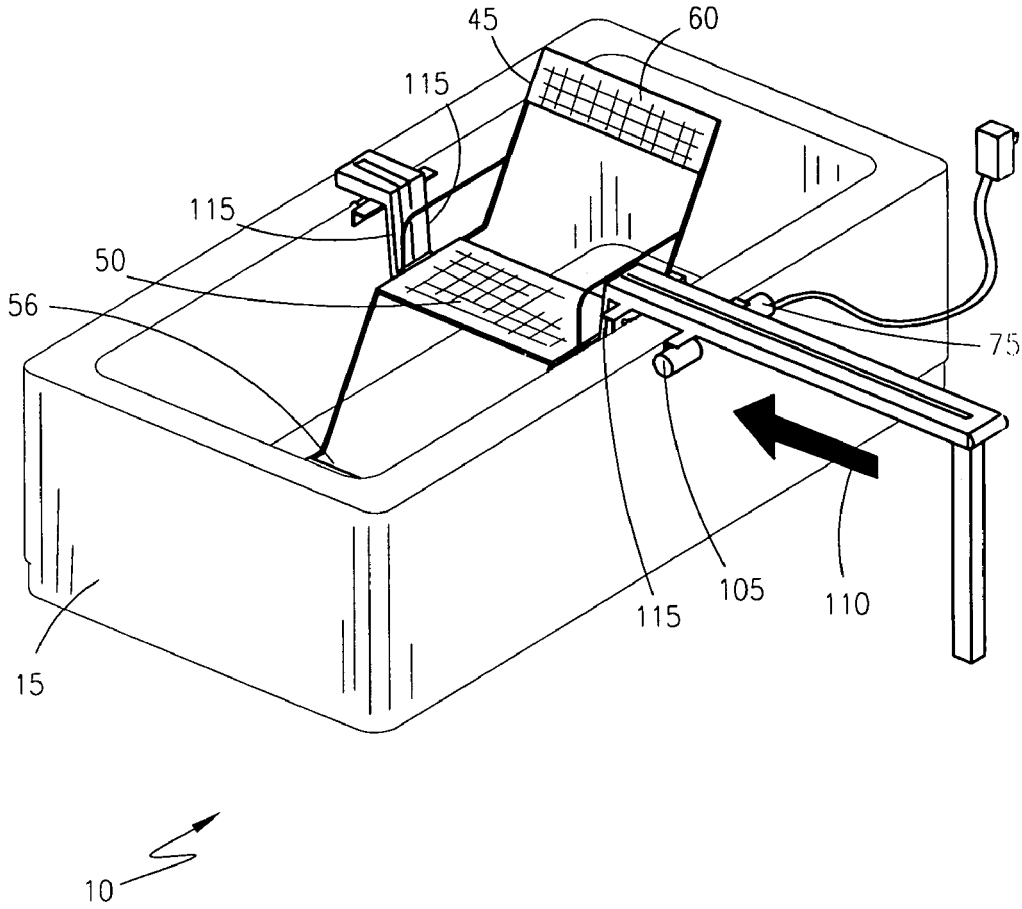
FIG. 2 is a perspective view of the bath tub bathing aid 10, shown in a utilized state according to the preferred embodiment of the present invention.
Figure 3:
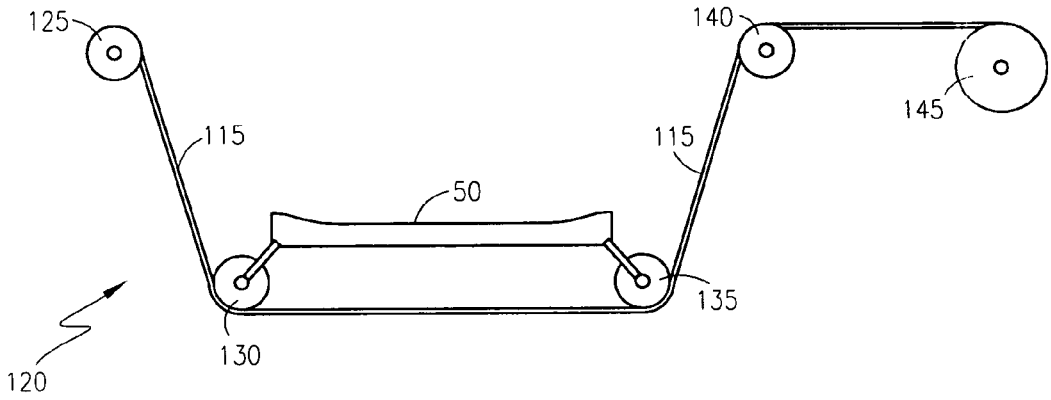
FIG. 3 is a side view of the pulley system used to raise and lower the seat surface 50.

The best mode for carrying out the invention is presented in terms of its preferred embodiment, herein depicted within FIGS. 1 through 3.

1. Detailed Description of the Figures

Referring first to FIG. 1, a perspective view of the bath tub bathing aid 10, according to the preferred embodiment of the present invention is disclosed in a ready to be utilized state. The bath tub bathing aid 10 is utilized on a conventional bath tub 15. A guide rail 20 straddles across or traverses the middle of the conventional bath tub 15 and projects outward or beyond the tub 15 in a substantially perpendicular manner. The guide rail 20 is held in place with a series of three mounting arms 25, the mounting arms 25 affixed to the tub via attachment means, such as screws, bolts or other fasteners. Each of the mounting arms 25 has a pair of suction cups 30 to aid in its retention to the surface of the conventional bath tub 15. (Note that only two are shown for sake of illustration). The guide rail 20 comprises an elongated body 22 having a coextensive platform 23, the platform 23 operatively coupled to a plurality of cables 115 for raising and lowering the chair 45. The guide rail 20 also comprises an elongated opening 24 substantially traversing the length of the body 22 and platform 23, the opening 24 receiving and guiding the track glide mechanism 70.

The outward portion or body 22 of the guide rail 20 is held up by a support leg 35 which rests upon a floor surface 40. A bathing seat or chair 45, complete with a seat surface 50, a foot rest 55 downwardly depending from the seat surface 50, a back rest 60 upwardly depending from the seat surface 50, and a pair of arm rests 65 is provided at a conventional elevation and attitude for a common chair. The bathing chair 45 is supported by guide rail 20, with the use of a track glide mechanism 70. A guide track motor 75, with the use of a guide track gearbox 80, propels the bathing chair 45 along the length of the guide rail 20. Power for the guide track motor 75, along with other components of the bath tub bathing aid 10, is provided from a power cord 85, connected to a ground fault interrupter plug 90. The ground fault interrupter plug 90 is intended to eliminate the risk of electric shock due to the invention's close proximity to water during use. The bathing chair 45 is shown in its outward or non-active use point. It is from this point that the user would access or egress the bathing chair 45 from a normal walking posture on the floor surface 40. An elevation motor 95 (raising and lowering chair 45), in conjunction with an elevation transmission 100, is used to raise and lower the bathing chair 45 into the conventional bath tub 15, and whose function will be described in greater detail herein below. Finally, a control panel 105, provides for the activation and direction of both the guide track motor 75 and chair lowering motor 95. Its location allows ease of access and operation from either end of the guide rail 20, whether the bathing chair 45 is in or out of the conventional bath tub 15.

Referring now to FIG. 2, a perspective view of the bath tub bathing aid 10, is shown in a utilized state. In this view the bathing chair 45 is lowered into the conventional bath tub 15. In said position, the user would be able to bathe. The bathing chair 45 is driven to this position by first activating the guide track motor 75 using the control panel 105. This action produces multiple actions. First, the foot rest 55 is moved to an elevated position, using a series of internal levers and gears. Next, the back rest 60 is reclined to a lowered position. Such a position puts the user in a reclined position, similar to what would be found sitting in a conventional recliner in a home. At this point the user is transported down the guide rail 20 as defined by a direction arrow 110. When the bathing chair 45 is centered over the conventional bath tub 15, the elevation motor 95 and the elevation transmission 100 are engaged to lower the bathing chair 45 into the bathing position as shown. This is accomplished by the use of four elevation cables 115, of only which three are shown for sake of simplicity. The plurality of elevation cables 115 are controlled via a pulley system 120, as will be described in greater detail herein below within the chair lowering transmission 100. Operation of the elevation motor 95 and the elevation transmission 100 are governed by the control panel 105, which is easily reachable and readily accessible when the bathing chair 45 is deployed inside of the conventional bath tub 15. The user is free to bathe or simply soak when the bathing chair 45 is in its deployed position. When complete, the user operates the conventional bath tub 15 to return the bathing chair 45 to its pre-deployed position, thus allowing the user to simply stand up from a sitting position to complete the bathing process.

Referring finally to FIG. 3, the internal operation of the pulley system 120 is described. The elevation cable 115 begins at a fixed pulley 125 and is routed downward to a first rotating pulley 130 fixed to the seat surface 50. A second rotating pulley 135 is located in a similar manner on the opposite side of the seat surface 50, through which the elevation cable 115 is routed ant then upward to a third rotating pulley 140. Finally, surplus elevation cable 115 is wound upon a take up pulley 145. In such a manner, the elevation cable 115, when retracted or extended from the take up pulley 145 results in raising or lowering of the seat surface 50 respectively. This configuration is repeated on the rear of the seat surface 50, resulting in a total of four elevation cable 115 that raise and lower the seat surface 50 as aforementioned described. FIG. 3 depicts two of said elevation cable 115 for purposes of illustration.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The preferred embodiment of the present invention can be used by the common operator in a simple and effortless manner, with minimal training. After procurement of the bath tub bathing aid 10, it must be installed in a conventional bath tub 15, and connected to a suitable source of electrical power with particular attention that the ground fault protected afforded by the power cord 85 and the ground fault interrupter plug 90 is utilized. The guide rail 20 must be secured by the use of the mounting arms 25 and the suction cups 30. The mounting arms 25 are adjustable in position to accommodate conventional bath tubs 15 of varying styles and sizes. After the support leg 35 is setup upon the floor surface 40, the bath tub bathing aid 10 is ready for use.

To use the bath tub bathing aid 10, the user prepares for bathing in the conventional manner by disrobing, and filling the conventional bath tub 15 with bath water of the appropriate temperature and quantity. Next, the user sits in the bathing chair 45 utilizing the seat surface 50, the foot rest 55 and the back rest 60. When seated, the user would activate the control panel 105. This will place the user in a reclined position by raising his or her legs, and reclining the upper torso. When fully reclined, the user is transported down the guide rail 20 and over the conventional bath tub 15. Next, the elevation motor 95 and the elevation transmission 100, lowers the bathing chair 45 and the user into the water. At this point the bathing process can begin. When completed, the user simply activates the control panel 105 to reverse the above process and remove the user from the conventional bath tub 15 with no effort required on the user's behalf. When fully removed, the user simply stands up from a sitting position in the bathing chair 45. At this point the bathing process is complete and the system is in a reset state ready for the next usage.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A bathing aid comprising:

a chair secured to a guide rail by a track glide mechanism;

said guide rail supported by a plurality of mounting arms affixed to a bath tub, said guide rail extending beyond the width of said tub and supported by a leg downwardly projected to a floor surface;

said track glide mechanism mechanically coupled to a guide track motor, said track glide mechanism urged along an axis of said guide rail by said guide track motor for controlling the linear movement of said chair;

an elevation motor mechanically coupled to a plurality of cables housed in said guide rail, said elevation motor raising and lowering said plurality of cables to adjust the elevation of said chair; and a power source providing electricity to said guide rail motor and said elevation motor.

2. The bathing aid of claim 1, wherein said chair comprises:

a seat surface;

a back rest surface upwardly depending from said seat surface, said back rest surface reclining upon actuation of said bathing aid;

a foot rest surface downwardly depending from said seat surface, said foot rest surface inclining upon actuation of said bathing aid; and a pair of arm rests, each one of said pair of arm rests aligned along lateral margins of said seat surface;

wherein reclining of said back rest surface and inclining of said foot rest surface combines to position a user in a substantially reclined position suitable for entry into a bath tub.

3. The bathing aid of claim 1, wherein said guide rail comprises:

an elongated body having a coextensive platform, said platform operatively coupled to said plurality of cables for raising and lowering said chair; and an elongated opening substantially traversing the length of said body and said platform, said opening receiving and guiding said track glide mechanism.

4. The bathing aid of claim 1, wherein said guide track motor operatively coupled to a gearbox that controls the linear direction of said chair.

5. The bathing aid of claim 1, wherein said plurality of mounting arms are fixedly attached to a bath tub via attachment means.

6. The bathing aid of claim 5, wherein each one of said plurality of mounting arms further comprises a plurality of suction cups suitable for adhering to a bath tub surface, said plurality of suction cups providing increased retention of said plurality of mounting arms thereto.

7. The bathing aid of claim 1, wherein said elevation motor urges extension and contraction of said plurality of cables about corresponding pulleys housed in said guide rail.

8. The bathing aid of claim 7, wherein said elevation motor is mechanically coupled to an elevation transmission, said elevation transmission urging said pulleys clockwise or counterclockwise to actuate extension or contraction of said plurality of cables.

9. The bathing aid of claim 1, wherein each one of said plurality of cables is of a sufficient length to permit lowering of said chair into bath water.

10. The bathing aid of claim 1, wherein said power source comprises a power cord coupled to a ground fault connector plug, said plug inhibiting the risk of electric shock to a user in the water.

11. The bathing aid of claim 1 further comprising a control panel for activating said guide rail motor and said elevation motor.

* * * * *